US005316374A

United States Patent [19]

Fidler

[11] Patent Number: 5,316,374

[45] Date of Patent: May 31, 1994

[54] PORTABLE FOOTREST APPARATUS

[76] Inventor: Raymond W. Fidler, 12321 Woodrun Dr., Laurinburg, N.C. 28352

[21] Appl. No.: 9,060

[22] Filed: Jan. 26, 1993

[51] Int. Cl.[5] ..... A47C 16/02

[52] U.S. Cl. ..... 297/423.39; 108/115; 190/102

[58] Field of Search ..... 297/423.39, 423.4, 423.46, 297/DIG. 6; 190/8, 102; 108/6, 115, 127

[56] References Cited

U.S. PATENT DOCUMENTS

| | | | |
|---|---|---|---|
| 3,005,662 | 10/1961 | Emery | 297/423.39 |
| 4,430,947 | 2/1984 | Kvame | 108/115 X |
| 4,533,179 | 8/1985 | Nichols | 108/115 X |
| 4,574,990 | 3/1986 | Remis | 190/8 X |
| 5,115,893 | 5/1992 | Terkildsen | 190/102 X |

FOREIGN PATENT DOCUMENTS

| | | | |
|---|---|---|---|
| 1430788 | 4/1976 | United Kingdom | 108/115 |
| 2052959 | 2/1981 | United Kingdom | 108/127 |

*Primary Examiner*—Kenneth J. Dorner
*Assistant Examiner*—David E. Allred
*Attorney, Agent, or Firm*—E. Michael Combs

[57] ABSTRACT

A first and second side plate are hingedly mounted together, with the first side plate including first and second end plates hingedly mounted to the first side plate, to each include at least one end plate slot to receive lug portions of the second side plate. The apparatus is arranged for interfolding relative to the plate structure for securement to a portable container to permit ease of transport and storage of the organization.

2 Claims, 4 Drawing Sheets 10
11
12
13
14
15
16
17

14
15
16
17
20
24
25
26
27
28
29
30
31
32
35
36

Fig 5
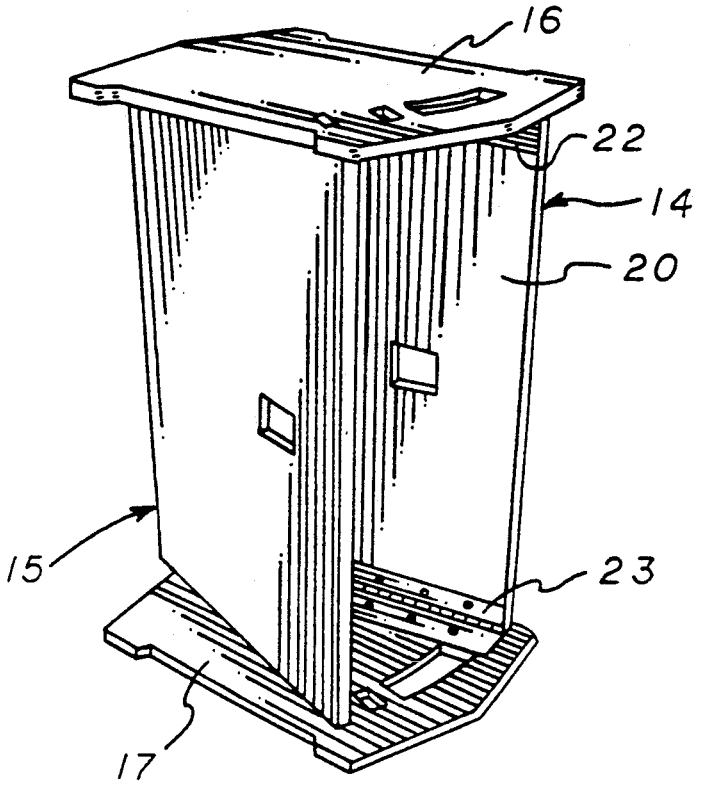
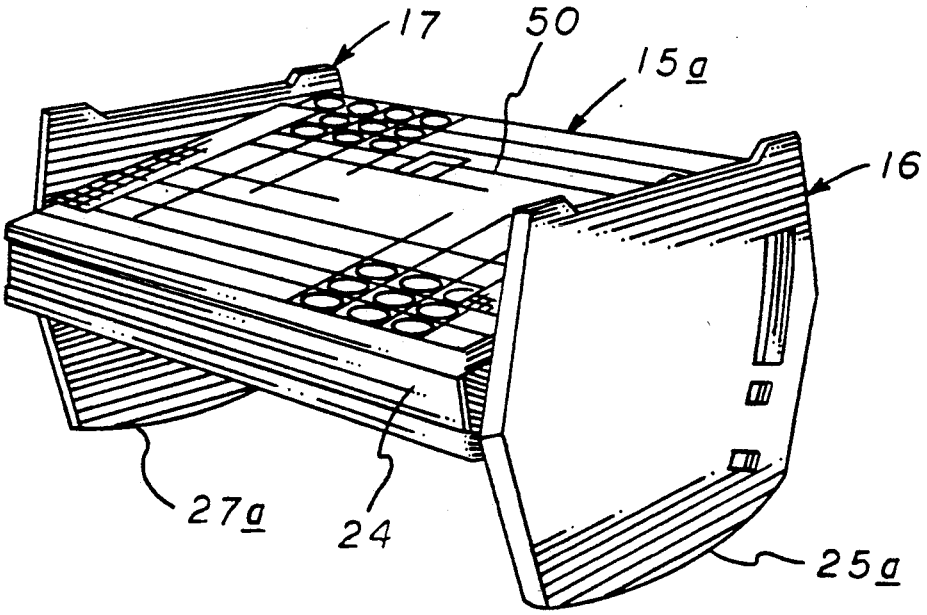
Fig 6

PORTABLE FOOTREST APPARATUS

BACKGROUND OF THE INVENTION

1. Field of the Invention

The field of invention relates to foot rest structure, and more particularly pertains to a new and improved portable footrest apparatus wherein the same is arranged for ease of interfolding for storage and transport thereof.

2. Description of the Prior Art

Footrest apparatus of various types have been available in the prior art and exemplified by such patents as U.S. Pat. Nos. 4,991,908; 3,770,316; 4,708,308; 4,462,363; and 4,013,318.

The instant invention addresses deficiencies of the prior art by providing a footrest structure arranged for ease of transport and mounting to a portable attache case and the like and in this respect, the present invention substantially fulfills this need.

SUMMARY OF THE INVENTION

In view of the foregoing disadvantages inherent in the known types of footrest apparatus now present in the prior art, the present invention provides a portable footrest apparatus wherein the same is arranged to include interfolding end walls and nesting side walls for ease of manipulation and storage of the organization. As such, the general purpose of the present invention, which will be described subsequently in greater detail, is to provide a new and improved portable footrest apparatus which has all the advantages of the prior art footrest apparatus and none of the disadvantages.

To attain this, the present invention provides a first and second side plate hingedly mounted together, with the first side plate including first and second end plates hingedly mounted to the first side plate, to each include at least one end plate slot to receive lug portions of the second side plate. The apparatus is arranged for interfolding relative to the plate structure for securement to a portable container to permit ease of transport and storage of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable footrest apparatus which has all the advantages of the prior art footrest apparatus and none of the disadvantages.

It is another object of the present invention to provide a new and improved portable footrest apparatus which may be easily and efficiently manufactured and marketed.

It is a further object of the present invention to provide a new and improved portable footrest apparatus which is of a durable and reliable construction.

An even further object of the present invention is to provide a new and improved portable footrest apparatus which is susceptible of a low cost manufacture with regard to both materials and labor, and which accordingly is then susceptible of low prices of sale to the consuming public, thereby making such portable footrest apparatus economically available to the buying public.

Still yet another object of the present invention is to provide a new and improved portable footrest apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric view of the invention indicating the mounting of the first side plate relative to the end plates.

FIG. 6 is an isometric illustration of a modified aspect of the invention.

DESCRIPTION OF THE PREFERRED EMBODIMENT

Figure 1:
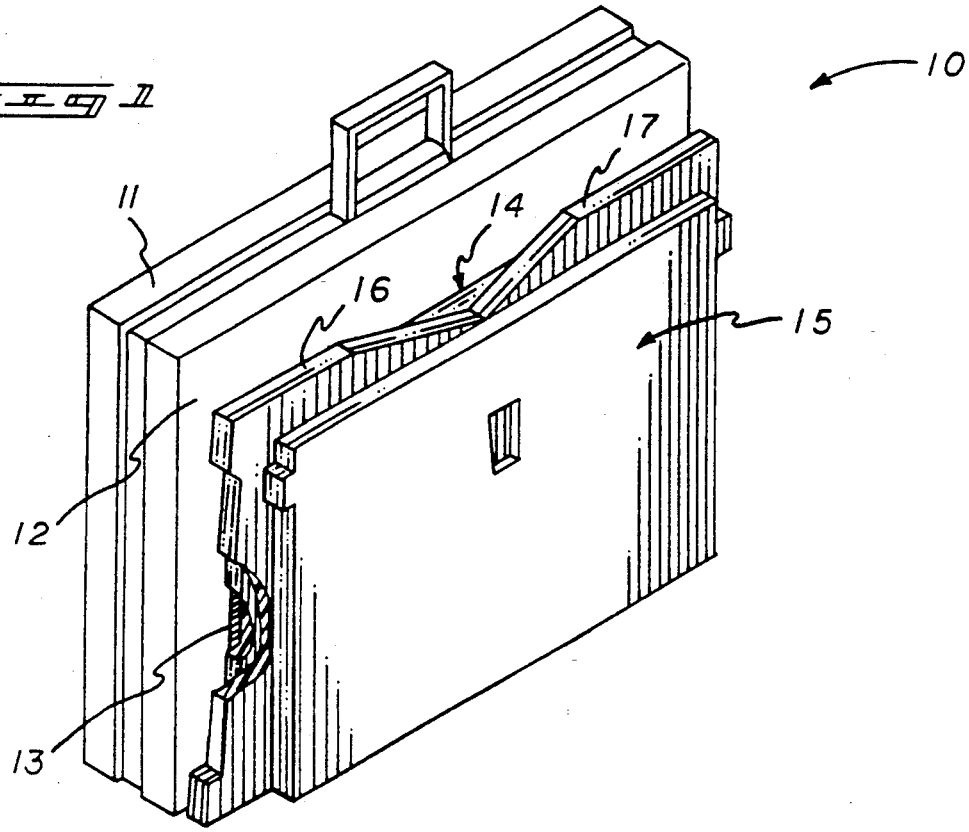
FIG. 1 is an isometric illustration of the invention.
Figure 2:
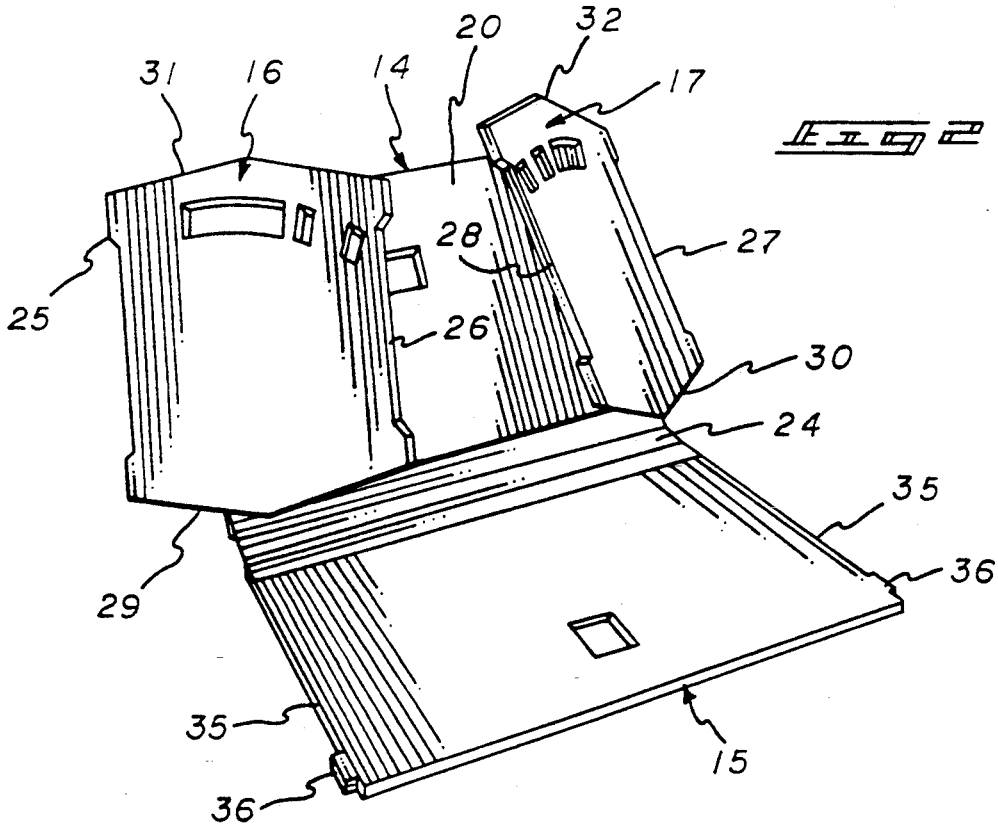
FIG. 2 is an isometric illustration of the footrest structure in a partially extended configuration.
Figure 3:
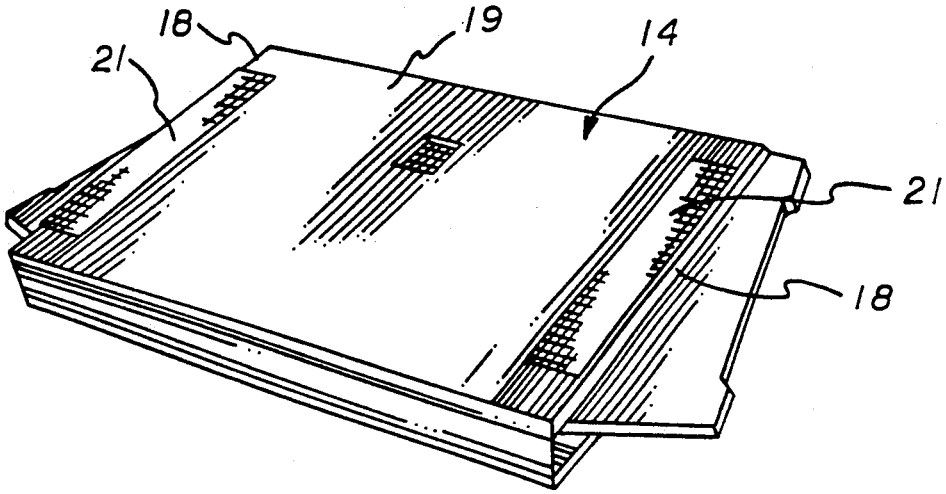
FIG. 3 is an isometric rear view of the footrest structure.

With reference now to the drawings, and in particular to FIGS. 1 to 10 thereof, a new and improved portable footrest apparatus embodying the principles and concepts of the present invention and generally designated by the reference numeral 10 will be described.

More specifically, the portable footrest 10 of the instant invention is arranged for securement to a transport container 11, having a container side wall 12. The container side wall 12 includes at least one, and preferably a plurality of, container hook and loop fastener strips 13 arranged in a parallel spaced relationship spaced apart a predetermined spacing. The footrest structure includes a first side plate 14 hingedly mounted to a second side plate 15 about a flexible hinge web 24 that is mounted to respective lowermost ends of the first and second side plates 14 and 15. When the device is in the closed, portable configuration a built-in latch retains the side plates 14 and 15 together and the device shut. A first end plate 16 and a second end plate 17 are hingedly mounted to the respective first plate end walls 18 about respective first end plate and second end plate hinges 22 and 23 respectively. The first and second end plate hinges 22 and 23 are directed from the first and second end plates 16 and 17 to the first plate front wall 20. The first plate rear wall 19 includes a plurality of first plate hook and loop fastener strips 21 in a parallel spaced relationship spaced apart the predetermined spacing for selective securement to the container hook and loop fastener strips 13 to permit ease of transport of the organization permitting mounting of the footrest structure to the transport container 11, such as illustrated in FIG. 1.

The first end plate 16 includes first end plate first and second sides 25 and 26 respectively, with the second end plate having second end plate first and second sides 27 and 28 respectively. The FIG. 6 indicates modified first and second end plate arcuate first sides 25*a* and 27*a* respectively to permit rocking of the structure if so desired.

Figure 4:
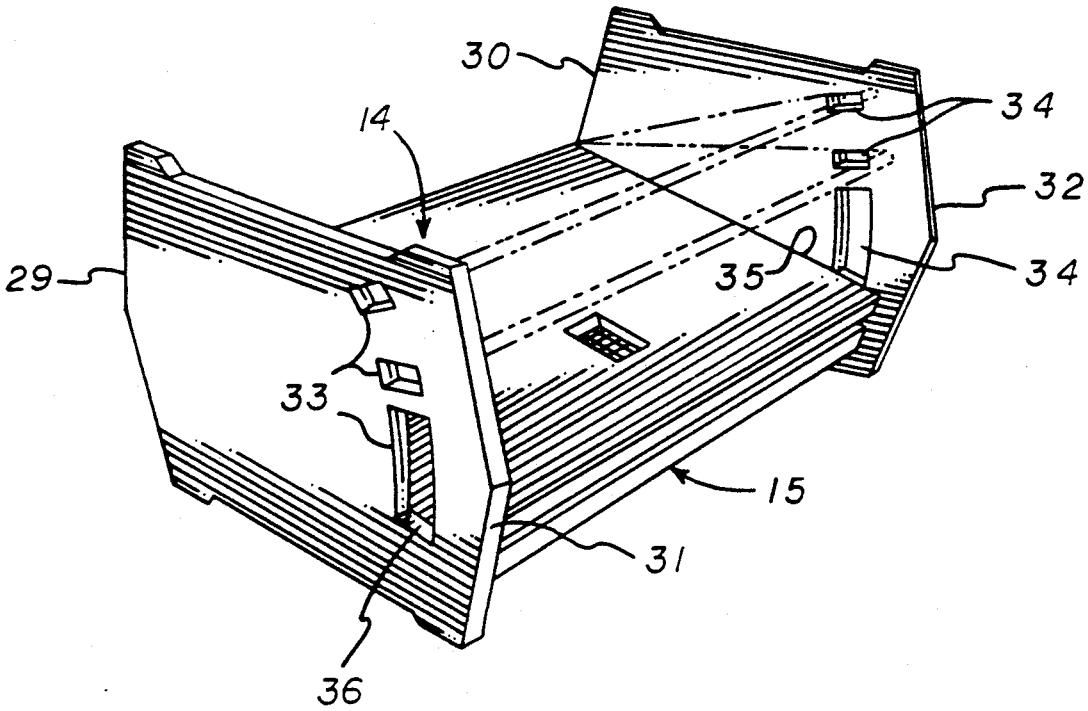
FIG. 4 is an isometric illustration of the invention and the footrest in various orientations for support of an individual's feet thereon.

The first end plate 16 includes a first end plate angulated first end 29 spaced from a first end plate angulated second end 31, with the second end plate having a second end plate angulated first end 30 spaced from a second end plate angulated second end 32. Each of the ends 29-32 are configured of intersecting planar surfaces intersecting at an obtuse included angle medially of each of the respective ends. A plurality of first arcuate slots 33 are directed through the first end plate in adjacency to the first end plate second end 31, with a plurality of second arcuate slots 34 directed through the second end plate adjacent the second end plate second end 32. The arcuate slots are arranged to each selectively receive a lug 36 mounted to one of the second side plate end walls 35, as illustrated in FIG. 4 for example, to provide for angular mounting of the first side plate relative to the second side plate, in a manner as indicated in FIG. 4 in the solid and phantom lines. The individual arcuate slots relative to each of the end plates permit such mounting.

Figure 7:
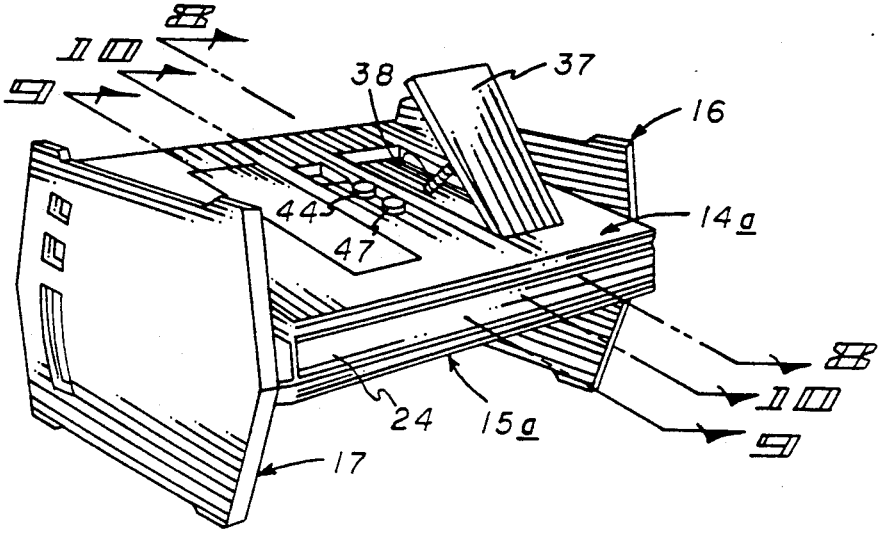
FIG. 7 is an isometric top view of the modified structure.
Figure 8:
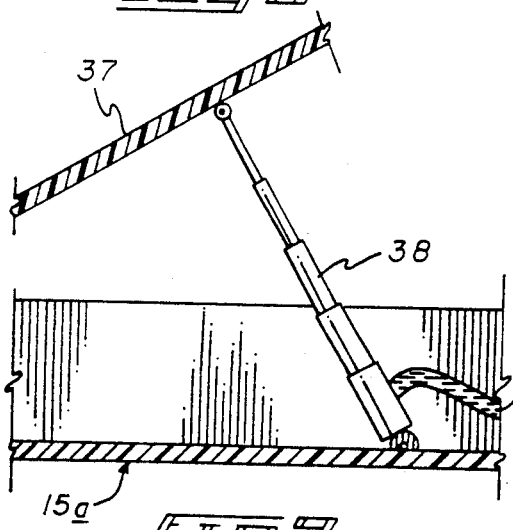
FIG. 8 is an orthographic view, taken along the lines 8—8 of FIG. 7 in the direction indicated by the arrows.
Figure 10:
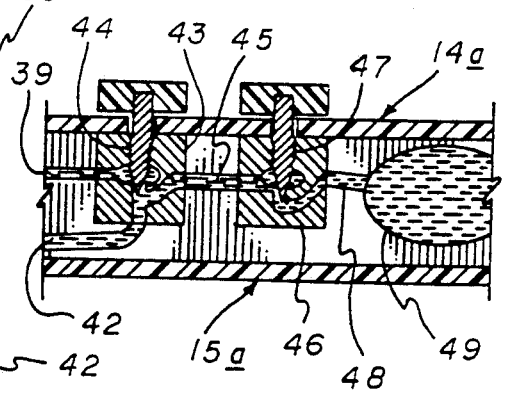
FIG. 10 is an orthographic view, taken along the lines 10—10 of FIG. 7 in the direction indicated by the arrows.
Figure 9:
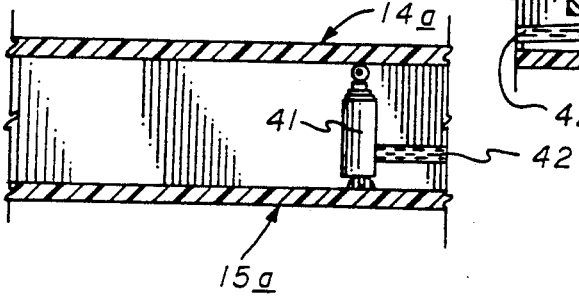
FIG. 9 is an orthographic view, taken along the lines 9—9 in the direction indicated by the arrows.

The FIG. 6 indicates the modified second end plate 15*a* having a textured bottom wall 50, with the modified first end plate and second end plate structure indicated in FIG. 7, with a treadle plate 37 pivotally mounted to the modified first side plate 14*a* having hydraulic pump 38 interposed between the treadle plate 37 and the second side plate 15*a*. A first conduit 39 is directed from the hydraulic pump 38 to a first fluid junction within a first valve 43. The first fluid junction includes the intersection of the first conduit 39, a second conduit 42, and a third conduit 45. The second conduit is directed from the first junction to a slave cylinder 41, whereupon pumping of the hydraulic pump 38 manually by the treadle plate 37 effects projection and extension of the slave cylinder 41 to provide for spacing of the first side plate to the second side plate as the slave cylinder is mounted between the first side plate and the second side plate in a pivotal relationship. A threaded plunger rod 44 directed into the first valve provides for selective blockage of the first conduit relative to fluid communication between the second and third conduits, as illustrated in FIG. 10. A second valve 46 is provided, having the third conduit directed from the first valve to the second valve, wherein the second valve includes a second valve plunger rod 47 to cease fluid flow between the third conduit and a fluid reservoir bladder 49. In this manner, upon directing the first valve plunger rod 44 to discontinue fluid flow between the first conduit relative to the second and third conduits, the slave cylinder is compressed, as indicated in FIG. 9, by directing fluid from the slave cylinder to the fluid bladder 49. Upon opening fluid flow from the first conduit to the second and third conduits, and directing the second valve plunger rod 47 to cease fluid flow between the third conduit and the reservoir, fluid flow from the hydraulic pump 38 effects extension of the slave cylinder 41 and attendant pivotal spacing of the first side plate relative to the second side plate 14*a* and 15*a* respectively.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable footrest apparatus, comprising, a first side plate and a second side plate, the first side plate having a first side plate lower end wall, the second side plate having a second side plate lower end wall, wherein the first side plate lower end wall and the second side plate lower end wall include a flexible hinge web pivotally mounting the first side plate to the second side plate, the first side plate having parallel first plate end walls, with each first plate end wall of said first plate end walls having an end plate attached thereto by, an end plate hinge, with the first side plate having a first side plate front wall and a first side plate rear wall, with each said end plate hinge secured to the first plate front wall adjacent one of said first plate end walls, and each end plate includes an end plate angulated first end and an end plate angulated second end, and each end plate includes a plurality of arcuate slots directed through each end plate adjacent said each end plate second end, the second side plate includes second side plate end walls, with each of said second side plate end walls including a lug, with each said lug arranged for reception within one of said arcuate slots of one of said end plates, and each end plate first end and second end includes intersecting planar sides intersecting at an obtuse included angle for angularly supporting each end plate, first side plate, and second side plate, and the first side plate rear wall includes a plurality of spaced parallel hook and loop fastener strips spaced apart a predetermined spacing, and a transport container, the container including container side wall, the container side wall includes container hook and loop fastener strips spaced apart said predetermined spacing to receive the end plate hook and loop fastener strips.

2. An apparatus as set forth in claim 1, wherein the first side plate includes a treadle plate pivotally mounted to the first side plate, and a hydraulic pump interposed between the treadle plate and the second side plate, and a first conduit, and a first valve, with the first conduit in fluid communication with the first valve, and a slave cylinder pivotally mounted between the first side and the second side plate, with a second conduit in fluid communication between the slave cylinder and the first valve, and a second valve, the second valve including a third conduit in fluid communication between the first valve and the second valve, wherein the first conduit, the second conduit, and the third conduit are directed into a fluid junction within the first valve, and a first plunger rod adjustably directed into the first valve to selectively stop fluid flow between the first conduit and the second conduit and third conduit, and a fluid reservoir bladder positioned between the first side plate and the second side plate in fluid communication with the third conduit, wherein the second valve includes a second valve plunger rod directed adjustably into the second valve to effect stoppage of fluid flow between the third conduit and the fluid reservoir bladder.

* * * * *